United States Patent [19]

Girard

[11] Patent Number: 4,675,081

[45] Date of Patent: Jun. 23, 1987

[54] CONTROLLING ALUMINIUM REDUCTION CELL OPERATION

[75] Inventor: Joseph S. S. Girard, Chicoutimi, Canada

[73] Assignee: Alcan International Limited, Montreal, Canada

[21] Appl. No.: 840,383

[22] Filed: Mar. 17, 1986

[30] Foreign Application Priority Data

Mar. 18, 1985 [EP] 03181985 ..... 85301856.2

[51] Int. Cl.[4] ..... C25C 3/06

[52] U.S. Cl. ..... 204/67; 204/225; 204/228; 204/245

[58] Field of Search ..... 204/67, 225, 228, 245

[56] References Cited

U.S. PATENT DOCUMENTS 3,539,461 11/1970 Newman et al. ..... 204/67

4,221,641 9/1980 Weber et al. ..... 204/67

4,540,474 9/1985 Voegel ..... 204/67

*Primary Examiner*—Donald R. Valentine

*Attorney, Agent, or Firm*—Cooper, Dunham, Griffin & Moran

[57] ABSTRACT

A method of determining the depth of the molten electrolyte layer in an aluminium electrolytic reduction cell, and using the measurement to control the operation of the cell, is based on the fact that when an anode is raised, the current passing through it drops to zero when the anode carbon face loses physical contact with the molten electrolyte. The method involves raising the anode and noting the distance travelled before the current falls to a predetermined fraction of its initial value. The method is well adapted to automatic control of electrolyte depth.

8 Claims, No Drawings

CONTROLLING ALUMINIUM REDUCTION CELL OPERATION

This invention relates to a method of determining the depth of the molten electrolyte layer in an aluminium electrolytic reduction cell, and to a method consequent thereon of controlling the operation of the cell. A typical reduction cell comprises a layer of molten electrolyte, generally based on cryolite $Na_3AlF_6$, containing dissolved alumina. Carbon anodes are suspended with their lower ends dipping into the cell electrolyte. The floor of the cell is cathodic and may be formed of carbon and/or may include cathode current collectors embedded in the potlining. Upon passage of electric current, molten aluminium metal is formed on the floor of the cell, and may form a layer underlying the electrolyte layer. Oxygen from the alumina reacts with the carbon anodes which are progressively consumed. A protective freeze of solidified electrolyte forms round and over the molten electrolyte layer, and the anodes project through this frozen crust. From time to time fresh alumina, and other ingredients required for cell operation, are added through a hole formed in the frozen crust.

Control of the depth of the molten electrolyte layer is an important aspect of cell control. If the depth of this layer is too small, minimum requirements of anode immersion may be met only with difficulty or not at all. If the depth is too great, there may be a danger of overflow of molten electrolyte during displacement of anodes when these are lowered to quench an anode effect.

In conventional practice, the depth of the molten electrolyte layer is measured manually. A hole is cut in the frozen crust, into which a steel rod is introduced vertically through the electrolyte layer into the molten metal pad. After a few seconds, the rod is withdrawn and the length of the layer of freeze (solid electrolyte) adhering to its surface is measured. Measurement of the level of molten metal in the cell is often made simultaneously. These methods have the disadvantage of being liable to human error both in the actual measurement and in the transfer of information. They run the risk of damage to the cell floor, particularly where this includes refractory hard metal such as titanium diboride. Moreover, the manual methods involve exposing the operator to arduous conditions of heat and dust.

It is an object of this invention to provide an improved method of measuring the depth of the molten electrolyte layer in the cell, which is susceptible to automation. Such measurement will generate information establishing the amount of electrolyte that needs to be added or removed in order to operate the cell at a constant electrolyte depth. The method is defined in the appended claims.

The invention is based on the fact that, when an anode is raised, the current passing through it drops to zero when the carbon face loses physical contact with the molten electrolyte layer. When an individual anode is raised relative to other anodes (as during an anode change) its current decreases as it moves up and drops to zero when physical contact with the electrolyte is lost. The method of the invention involves monitoring the individual anode current, and a knowledge of the movement of the anode. It is, therefore, ideally suited for cells equipped with individual anode drives. The method essentially involves determining the distance (H) by which the anode must rise before its current drops to a predetermined small fraction (typically 5% to 10%) of its initial value. This distance (H) represents a close approximation of the original immersion of the anode in the molten electrolyte, less the electrolyte depth equivalent ($H_e$) corresponding to the original electrolyte displacement of the anode before removal. This depth equivalent ($H_e$) can easily be calculated from the geometry of the cell and an estimate of the freeze (solid electrolyte adhering to the inside of the sides of the cell cathode) thickness. Alternatively, $H_e$ can be determined experimentally. The actual electrolyte depth can then be obtained by adding the value of the anode-cathode distance (ACD) thickness of the molten electrolyte layer between the anode face and the top surface of the cathode (generally the metal pad) to the two values determined above, i.e.

$$\text{Electrolyte depth} = H + H_e + ACD.$$

Controlling the operation of a cell generally involves setting a target resistance corresponding to a target ACD. In the above formula, it is possible with reasonable accuracy to assume that the initial ACD (i.e. the ACD just before the anode starts to be raised) is the same as the target ACD. If greater accuracy is required, this can be achieved by comparing the actual resistance of the cell to its target value and applying a correction factor based on the known relation between ACD and cell resistance.

Since the current passing through the anode depends among other things on the extent to which it is immersed in the electrolyte layer, a further correction can be applied by making use of the known relation between initial overall ACD (calculated as described above) and initial immersion of the individual anode.

In the practice of the method, it is not necessary to actually measure the vertical distance that the anode must move before its current is reduced to a predetermined fraction of the initial value. This distance may be deduced from a time measurement and a known rate of movement of the anode. The size of the predetermined fraction is not critical and can indeed be zero, but is conveniently 5 to 10% of the initial value. The measurement may conveniently be performed at the time a spent anode stub is removed and replaced by a fresh prebake anode.

In a preferred method for practice of the invention, the spent anode is raised for a sufficient distance to ensure its complete removal from the bath while the anode current is continuously monitored. Such a distance may for example be 20 cm. The point in time at which the anode current falls to the predetermined fraction of the initial value is noted and converted automatically by a control system into a signal indicative of vertical movement. The control system then applies the corrections. The signal so obtained is applied in the system to control the depth of the molten electrolyte layer by addition of electrolyte to, or removal of electrolyte from, the cell. Electrolyte is generally added in the form of solid crushed bath from a previous cell.

EXAMPLE

Both the manual method of the prior art and the electrical method of this invention were used simultaneously to determine the depth of the molten electrolyte layer in a cell. The results are set out in the following table, and show a good measure of agreement between the two methods.

| (1) Manual Measurement (cm) | (2) Measure Using the Invention (cm) | Difference (1)-(2) (cm) |
|---|---|---|
| 20.0 | 18.3 | 1.7 |
| 18.0 | 19.1 | −1.1 |
| 18.0 | 20.1 | −2.1 |
| 20.0 | 19.1 | 0.9 |
| 19.0 | 20.8 | −1.8 |
| 19.0 | 19.9 | −0.9 |
| 18.0 | 19.3 | −1.3 |
| 16.0 | 19.9 | −3.9 |
| 18.0 | 18.5 | −0.5 |
| 18.0 | 17.3 | 0.7 |
| 22.0 | 22.2 | −0.2 |
| 21.0 | 23.2 | 2.2 |
| 17.0 | 18.9 | −1.9 |
| 16.0 | 18.6 | −2.6 |
| 17.0 | 19.3 | −2.3 |
| 18.0 | 17.2 | 0.8 |

Average on difference: −1.04
Standard deviation: 1.52

I claim:

1. A method of determining the depth of the molten electrolyte layer in an aluminium electrolytic reduction cell which has a plurality of anodes including an anode through which an initial current is passing, which method comprises raising the anode while monitoring the passage of current therethrough and measuring the vertical distance travelled by the anode before the current falls to a predetermined fraction of its initial value.

2. A method as claimed in claim 1, wherein the anode is raised at a known steady rate and the vertical distance travelled is deduced from the time taken for the current to fall to the predetermined fraction.

3. A method as claimed in claim 1, wherein a correction is made to take account of the initial displacement of electrolyte by the anode.

4. A method as claimed in claim 1, wherein a correction is made to take account of the initial anode-cathode distance of the cell.

5. A method as claimed in claim 4, wherein the cell has a target resistance corresponding to a target anode-cathode distance, and wherein a correction is made to take account of variations in the anode-cathode distance by comparing the initial cell resistance to its target value.

6. A method as claimed in claim 1, wherein a correction is made to take account of the extent of initial immersion of the anode being monitored.

7. A method as claimed in claim 1, wherein the predetermined fraction is 5 to 10%.

8. A method of controlling the operation of an aluminium electrolytic reduction cell which includes a molten electrolyte layer into which dip a plurality of anodes including an anode through which an initial current is passing, which method comprises raising the anode while monitoring the passage of current therethrough, generating a signal indicating the vertical distance travelled by the anode before the current falls to a predetermined fraction of its initial value, and using the signal to control the depth of the molten electrolyte layer by addition of the electrolyte to, or removal of electrolyte from, the cell.

* * * * *